US007044454B2

(12) United States Patent
Colman et al.

(10) Patent No.: US 7,044,454 B2
(45) Date of Patent: May 16, 2006

(54) MATTRESS INNER SPRING ASSEMBLY

(75) Inventors: Graham Colman, Gauteng (ZA); Gianni Nosenzo, Gauteng (ZA); Leonard Patrick Mizra, Gauteng (ZA)

(73) Assignee: Bedding Component Manufacturers (Proprietary) Limited, Johannesburg (ZA)

( * ) Notice: Subject to any disclaimer, the term of this patent is extended or adjusted under 35 U.S.C. 154(b) by 66 days.

(21) Appl. No.: 10/929,812

(22) Filed: Aug. 30, 2004

(65) Prior Publication Data

US 2005/0235426 A1 Oct. 27, 2005

(30) Foreign Application Priority Data

Apr. 23, 2004 (ZA) ..... 2004/3129

(51) Int. Cl.
*A47C 23/04* (2006.01)
*F16F 13/00* (2006.01)

(52) U.S. Cl. ..... 267/91; 5/248; 5/716; 5/655.7; 267/103

(58) Field of Classification Search ..... 5/716, 5/655.7, 248, 246, 256; 267/103, 75, 80, 267/91, 142, 93, 97, 100, 101, 89
See application file for complete search history.

(56) References Cited

U.S. PATENT DOCUMENTS 6,375,169 B1 * 4/2002 McCraw et al. ..... 267/75
6,758,078 B1 * 7/2004 Wells et al. ..... 72/134

* cited by examiner

*Primary Examiner*—Alexander Grosz
(74) *Attorney, Agent, or Firm*—Wood, Phillips, Katz, Clark & Mortimer

(57) ABSTRACT

The invention concerns inner spring assemblies for mattresses, typically bed mattresses. The invention proposes an inner spring assembly having open-ended coil springs arranged in first rows and second rows transverse to the first rows and a connecting arrangement which connects the coil springs to form a unitary assembly. For ease of manufacture all the coil springs in the assembly are of the same hand, those in the first rows are oriented similarly to all other springs in the same first row and in at least some of the second rows there are springs which are oriented oppositely to other coil springs in the same second row.

4 Claims, 3 Drawing Sheets

MATTRESS INNER SPRING ASSEMBLY

BACKGROUND TO THE INVENTION

THIS invention relates to a mattress inner spring assembly.

The term "mattress" is used broadly in this specification to refer to a resilient cushion for use as a bed mattress or as a cushion in other items of upholstered furniture, for example chairs or sofas.

The invention is specifically concerned with mattress inner spring assemblies which make use of open-ended coil springs such as so-called LFK springs. It is well known in the art that such springs have a tendency to incline or cant in a preferential direction when compressed. Such tendency is described in detail and is illustrated in U.S. Pat. No. 6,375,169 assigned to Hickory Springs Manufacturing Company. As explained with reference to FIG. 1 of this document, the inner spring assembly of the mattress will exhibit severe lateral instability if all the springs are of the same hand, i.e. their coils spiral in the same direction, and are similarly oriented.

With reference to FIG. 2, U.S. Pat. No. 6,375,169 also describes one prior attempt to overcome the problem of lateral instability by using alternating rows of springs with the springs in one row of opposite hand to the springs in the adjacent rows. With reference to FIGS. 7 and 9 the document describes other potential solutions to the lateral instability problem. In the proposal illustrated in FIG. 7, each row and each column of springs in the assembly is composed of springs which alternate between right hand and left hand. Like the proposal illustrated in FIG. 2, the use of springs of different hand may create problems in automatic assembly. The FIG. 9 proposal is a complicated one making use of springs which are all of the same hand but in which each row and each column is composed of springs of alternating orientation.

It is an object of the present invention to provide a somewhat simpler construction in which all springs are of the same hand.

SUMMARY OF THE INVENTION

According to the present invention there is provided a mattress inner spring assembly comprising a plurality of open-ended coil springs arranged in first rows and second rows transverse to the first rows, and means connecting the coil springs to form a unitary assembly, wherein all coil springs in the assembly are of the same hand, wherein each coil spring in each first row is oriented similarly to other coil springs in the same first row, and wherein in at least some of the second rows some of the coil springs are oriented oppositely to other coil springs in the same second row.

Where this specification refers to coil springs being oriented similarly to other coil springs, it is meant that the coil springs are oriented in the same way about their upright axes such that the coil springs have a tendency to incline in the same linear direction when compressed.

In a preferred embodiment, the coil springs in first rows located at end regions of the assembly where the head and feet of a person lying on the mattress can be expected to lie in use, are similarly oriented, while coil springs in alternate first rows located in a middle region of the assembly are oriented oppositely to one another, thereby to improve lateral stability in the middle region.

BRIEF DESCRIPTION OF THE DRAWINGS

The invention will now be described in more detail, by way of example only, with reference to the accompanying drawings.

In the drawings.

DESCRIPTION OF THE PREFERRED EMBODIMENT

Figure 1:
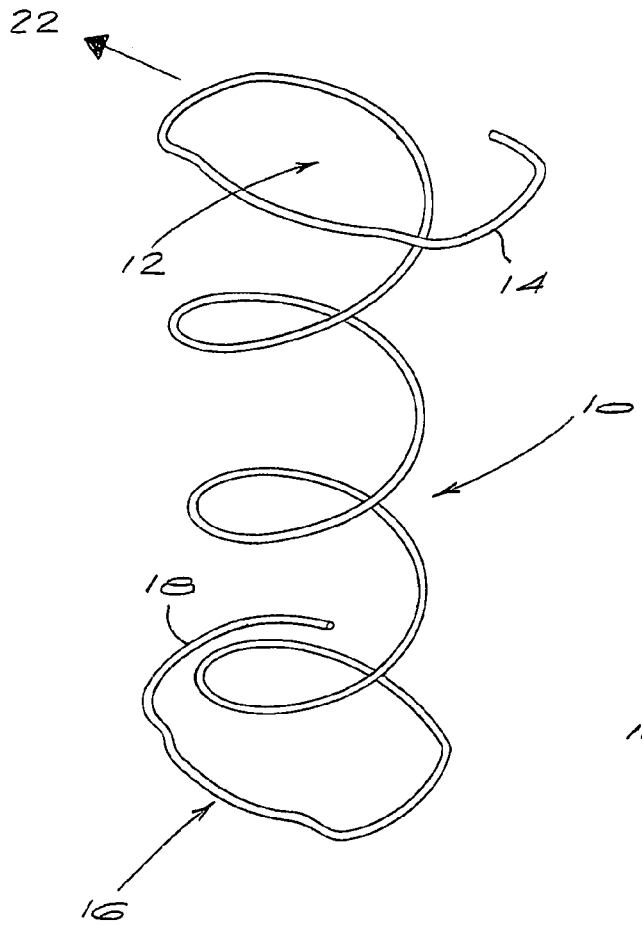
FIG. 1 shows a perspective view of an open-ended coil spring used throughout a spring assembly according to the invention.
Figure 2:
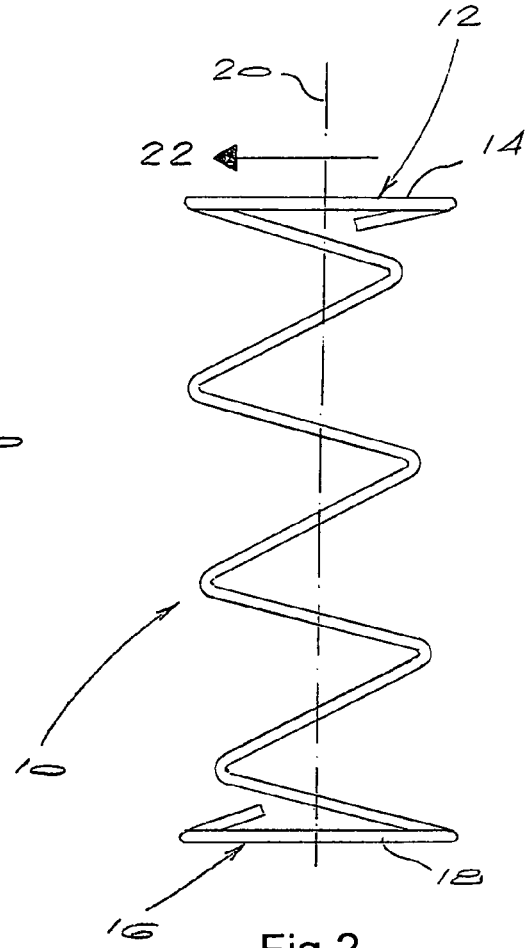
FIG. 2 shows a side view of the spring seen in FIG. 1.
Figure 3:
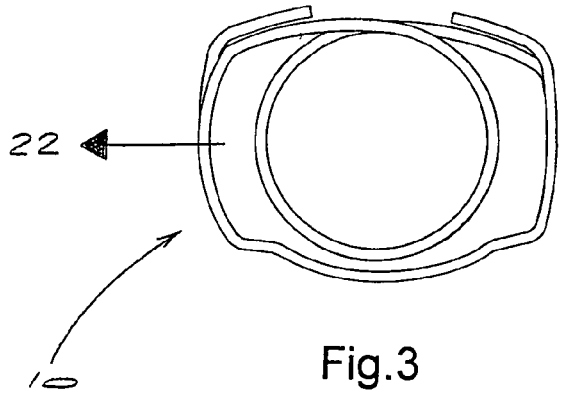
FIG. 3 shows a plan view of the spring seen in FIGS. 1 and 2.

FIGS. 1 to 3 illustrate a single open-ended coil spring 10, in this case a so-called LFK spring, consisting of spring wire bent to the illustrated shape. The spring 10 has an open upper end 12 terminating in a bend 14 and an open lower end 16 terminating in a bend 18. The upper and lower ends 12 and 16 lie in respective, generally parallel planes spaced vertically apart from one another and the spring has a vertical axis 20 when in a normal, relaxed state. Proceeding downwardly from the upper end 12 to the lower end 16 the spring wire undergoes three complete turns in a clockwise direction. The spring is accordingly a right hand spring.

Persons skilled in the art will understand that a spring of the illustrated kind has a tendency to incline or cant in one preferential direction when the spring is axially compressed. The preferential direction of inclination of the illustrated right hand spring is indicated by the numeral 22 in FIG. 2.

Figure 4:
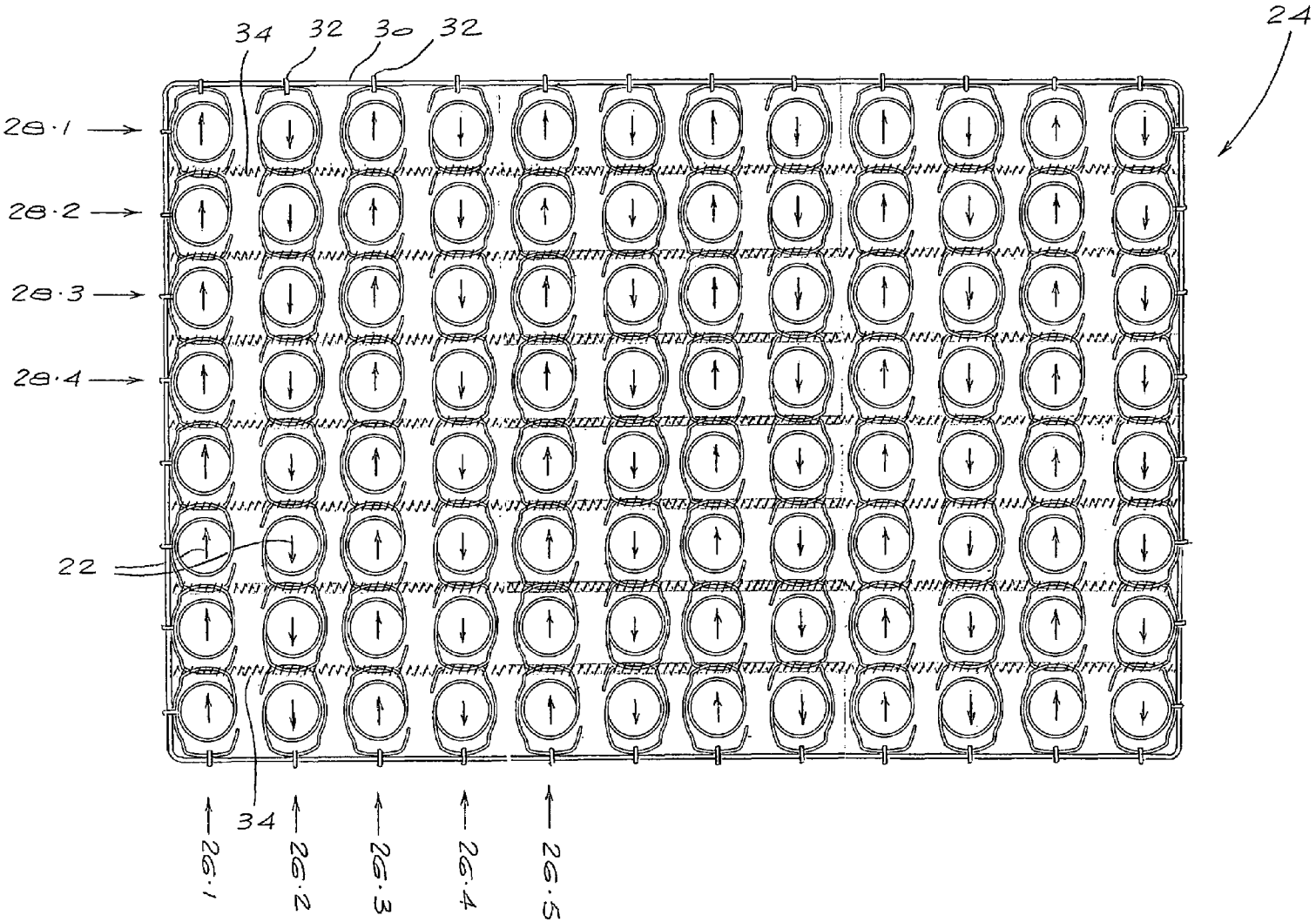
FIG. 4 shows a diagrammatic plan view of a mattress inner spring assembly according to a first embodiment of the invention.

FIG. 4 shows a diagrammatic plan view of a mattress inner spring assembly 24 according to a first embodiment of this invention. The assembly 24 is rectangular in overall shape and incorporates coil springs 10 in a rectangular array composed of first rows 26.1, 26.2, 26.3, . . . of springs and second rows 28.1, 28.2, 28.3, . . . of springs at right angles to the first rows. The outermost springs in the array are fastened to upper and lower bounding wires 30 (only the upper bounding wire is visible in FIG. 4) by means of clips 32.

The second rows of springs are fastened to one another by upper and lower spiral connecting wires 34 (only the upper connecting wires are visible in FIG. 4) threaded through relevant portions of the upper and lower ends of the springs. In combination, the bounding wires 30 and connecting wires 34 constitute a conventional connecting means which holds the springs 10 together in the unitary assembly 24.

It will be noted that every spring 10 in the assembly 24 is a right hand spring as described above with reference to FIGS. 1 to 3. It will also be noted that each spring in first each row 26.1, 26.2, 26.3, . . . is oriented similarly to the other springs in the same first row 26.1, 26.2, 26.3, . . . . However it will also be noted that the springs in alternate first rows 26.1, 26.3, 26.5, . . . are oriented oppositely to the springs in intermediate first rows 26.2, 26.4, 26.6, . . . . Thus the inclinational tendency of the springs in the rows 26.1. 26.3, 26.5, . . . is countered by the inclinational tendency of the springs in the rows 26.2, 26.4, 26.6, . . . . This is illustrated by the arrows 22 which indicate the inclinational tendency of the individual springs. It is expected that this feature will contribute to enhanced lateral stability of the inner spring assembly compared to assemblies incorporating springs of the same hand and orientation throughout.

Figure 5:
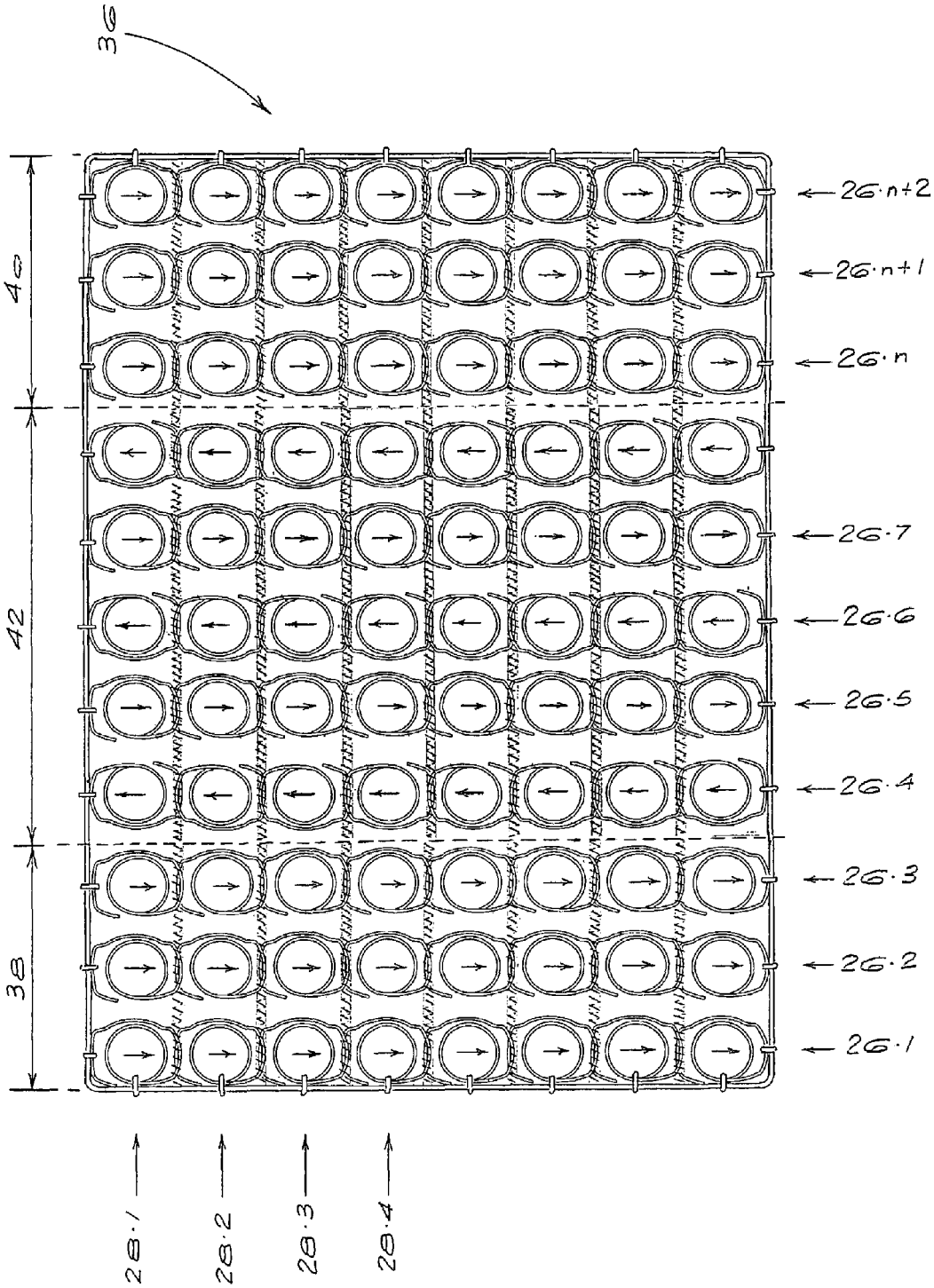
FIG. 5 shows a diagrammatic plan view of a mattress inner spring assembly according to a second embodiment of the invention.

It is recognised that the greatest proportion of a person's weight is usually in the waist region, and accordingly that the middle region of a mattress requires greater lateral stability than end regions which bear the reduced weight of the head and feet of a person reclining on the mattress. FIG. 5 shows a preferred embodiment which takes this into account.

The spring assembly 36 seen in FIG. 5 is intended for use in a bed mattress and has end regions 38 and 40 and a middle region 42. The end regions correspond to areas of the eventual mattress where the head and feet of a person reclining on the mattress can be expected to lie, while the middle region corresponds to an area of the eventual mattress where the waist of the reclining person can be expected to lie.

The first and second rows of springs are indicated in FIG. 5 by the same numerals used in FIG. 4, i.e. 26.1, 26.2, 26.3, . . . for first rows of springs and 28.1, 28.2, 28.3, . . . for second rows of springs. It will be seen that the first rows 26.1, 26.2 and 26.3 lie in the end region 38, the first rows **26.*n*, 26.*n*+1, 26.*n*+2 lie in the end region 40 and the remaining, intermediate rows 26.4, 26.5, . . . lie in the middle region 42**.

As in FIG. 4, all the springs in the assembly 36 are of similar hand. In the end region 38, each spring in each row 26.1, 26.2, 26.3 is oriented similarly to other springs in the same row and, in fact, to other springs in these rows. There is a similar configuration of springs in the region 40, but it will be understood that in other embodiments the springs in the region 40 could be oriented oppositely to the springs in the region 38.

In the middle region 42, the springs in alternate rows 26.4, 26.6, . . . are oriented oppositely to the springs in intermediate rows 26.5, 26.7, . . . . Thus in this configuration, counteracting inclinational tendencies are provided in the middle region 42 only. It is believed that this spring configuration will contribute to lateral stability of the spring assembly 36 in the middle region 42 where the greatest compressive load is applied in use and where lateral instability is most likely to be felt and is least desirable.

FIG. 5 illustrates that it is possible within the scope of the invention to provide selectively for enhanced lateral stability in a middle region of the inner spring assembly. Although the middle region is specifically mentioned it will however be understood that it is also possible, within the scope of the invention, to provide selectively for enhanced lateral stability in other localised regions of the assembly.

It will also be understood that the terms "first row" and "second row" are used for convenience only and that the invention is in no way limited by the directions in which the respective rows extend. Thus whereas the first rows extend widthwise and the second rows extend lengthwise in the assembly in FIGS. 4 and 5, the second rows could extend widthwise and the first rows lengthwise in other embodiments of the invention.

FIGS. 4 and 5 illustrate inner spring assemblies to be used in bed mattresses. It is believed that the assembly described above with reference to FIG. 4, the principles of which are also applicable to mattresses other than bed mattresses, will be simpler to construct than those described in U.S. Pat. No. 6,375,169 while still providing adequate lateral stability. The assembly described above with reference to FIG. 5, while in some respects even simpler in construction, can provide desirable lateral stability selectively in a critical zone of a bed mattress.

It will be understood that FIGS. 4 and 5 are diagrammatic and show a smaller number of coil springs than there would in practice be in a full bed mattress inner spring assembly.

We claim:

1. A mattress inner spring assembly comprising:

a plurality of open-ended coil springs arranged in first rows and second rows transverse to the first rows; and means connecting the coil springs to form a unitary assembly, wherein:

all coil springs in the assembly are of the same hand;

each coil spring in each first row is oriented similarly to other coil springs in the same first row; and in at least some of the second rows some of the coil springs are oriented oppositely to other coil springs in the same second row.

2. A mattress inner spring assembly according to claim 1 wherein all coil springs in alternate first rows are oriented similarly to one another, all coil springs in intermediate first rows are oriented similarly to one another and the coil springs in the alternate first rows are oriented oppositely to the coil springs in the intermediate first rows.

3. A mattress inner spring assembly according to claim 1, for use in a bed mattress having end regions where the head and feet of a person reclining on the mattress can be expected to lie and a middle region between the end regions, wherein springs in first rows in each end region of the assembly corresponding to an end region of the mattress are oriented similarly to springs in other first rows in the same end region, and wherein springs in alternate first rows located in a middle region of the assembly corresponding to the middle region of the mattress are oriented oppositely to springs in intermediate first rows in the middle region, thereby to promote lateral stability in the middle region of the assembly.

4. A mattress inner spring assembly according to claim 3 wherein all springs in first rows in both end regions of the assembly are similarly oriented.

* * * * *